US009210515B2

(12) United States Patent
Lee et al.

(10) Patent No.: US 9,210,515 B2
(45) Date of Patent: Dec. 8, 2015

(54) ACOUSTIC SENSOR

(71) Applicant: Electronics and Telecommunications Research Institute, Daejeon (KR)

(72) Inventors: Jaewoo Lee, Daejeon (KR); Chang Han Je, Daejeon (KR); Woo Seok Yang, Daejeon (KR); Jong-Kee Kwon, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/243,755

(22) Filed: Apr. 2, 2014

(65) Prior Publication Data

US 2015/0117680 A1 Apr. 30, 2015

(30) Foreign Application Priority Data

Oct. 29, 2013 (KR) ..... 10-2013-0129427

(51) Int. Cl.
*H04R 25/00* (2006.01)
*H04R 19/00* (2006.01)

(52) U.S. Cl.
CPC ..... *H04R 19/005* (2013.01); *H04R 2201/003* (2013.01)

(58) Field of Classification Search
CPC ..... H04R 19/05; H04R 19/04
USPC ..... 381/172–176; 367/188–190
See application file for complete search history.

(56) References Cited

U.S. PATENT DOCUMENTS

| | | | | |
|---|---|---|---|---|
| 5,573,679 | A | 11/1996 | Mitchell et al. | |
| 2006/0134904 | A1 | 6/2006 | Araki et al. | |
| 2008/0031476 | A1 * | 2/2008 | Wang et al. | 381/174 |
| 2010/0181637 | A1 * | 7/2010 | Harada et al. | 257/459 |
| 2011/0278683 | A1 * | 11/2011 | Kasai et al. | 257/416 |
| 2012/0098076 | A1 * | 4/2012 | Lee et al. | 257/416 |
| 2013/0100779 | A1 * | 4/2013 | Lee et al. | 367/188 |

OTHER PUBLICATIONS

Alfons Dehé,"Silicon microphone development and application", Science Direct, Sensors and Actuators A, Jul. 20, 2006, pp. 283-287, vol. 133, No. 2, Elsevier B.V.

* cited by examiner

*Primary Examiner* — Brian Ensey
*Assistant Examiner* — Julie X Dang

(57) ABSTRACT

Provided are an acoustic sensor and a method of manufacturing the same. The acoustic sensor includes a substrate including an acoustic chamber, a first hole, and a second hole, penetrating the substrate, a lower electrode pad extended onto a top surface of the substrate while covering a sidewall of the first hole, a diaphragm pad extended onto the top surface of the substrate while covering a sidewall of the second hole, a lower electrode provided on the acoustic chamber and connected to the lower electrode pad, and a diaphragm above the lower electrode while being separated from the lower electrode and connected to the diaphragm pad.

17 Claims, 17 Drawing Sheets

ACOUSTIC SENSOR

CROSS-REFERENCE TO RELATED APPLICATIONS

This U.S. non-provisional patent application claims priority under 35 U.S.C. §119 of Korean Patent Application No. 10-2013-0129427, filed on Oct. 29, 2013, the entire contents of which are hereby incorporated by reference.

BACKGROUND OF THE INVENTION

The present invention disclosed herein relates to a micro device using micro electro mechanical systems (MEMS), and more particularly, to a condenser-type acoustic sensor.

Acoustic sensors, in other words, microphones convert voices into electric signals. Recently, as it is accelerated to develop small-sized wired or wireless devices, the size of acoustic sensors gradually becomes miniaturized. According thereto, recently, acoustic sensors using MEMS have been developed.

Acoustic sensors are largely classified into a piezo type and condenser type. In case of the piezo-type, a piezo effect, in which a potential difference occurs between both ends of a piezoelectric material when a physical pressure is applied to the piezoelectric material, is used to convert a pressure of a voice signal into an electric signal. The piezo type has a lot of limitations in being applied, due to a low band and uneven characteristics of a voice band frequency. In case of the condenser type, a theory of a condenser, in which two electrodes are opposite to each other, is applied. One electrode of an acoustic sensor is fixed and another functions as a diaphragm. In this case, when a diaphragm vibrates according to a pressure of a voice signal, a capacitance between electrodes is changed and condensed charges are changed, thereby allowing a current to flow. The condenser type has excellent stability and frequency characteristics. Due to frequency characteristics described above, condenser-type acoustic sensors are generally used.

SUMMARY OF THE INVENTION

The present invention provides a miniaturized acoustic sensor.

The present invention also provides an acoustic sensor having improved reliability.

Embodiments of the present invention provide acoustic sensors including a substrate including an acoustic chamber, a first hole, and a second hole, penetrating the substrate, a lower electrode pad extended onto a top surface of the substrate while covering a sidewall of the first hole, a diaphragm pad extended onto the top surface of the substrate while covering a sidewall of the second hole, a lower electrode provided on the acoustic chamber and connected to the lower electrode pad, and a diaphragm above the lower electrode while being separated from the lower electrode and connected to the diaphragm pad.

In some embodiments, the diaphragm pad may be separated from the lower electrode pad.

In other embodiments, the acoustic sensor may further include a sacrificial layer disposed between the lower electrode pad and the diaphragm.

In still other embodiments, the acoustic sensor may further include a supporting film provided in the acoustic chamber and connected to the substrate and a substrate insulating film provided on the supporting film and the top surface of the substrate, in which the substrate insulating film may be extended between the substrate and the lower electrode pad and between the substrate and the diaphragm pad, and the lower electrode may be provided on the substrate insulating film.

In even other embodiments, the diaphragm pad may include the same material as the diaphragm.

In yet other embodiments, the lower electrode pad may include the same material as the lower electrode.

In further embodiments, a lowest surface of the lower electrode pad and a lowest surface of the diaphragm pad may form a coplanar together with a bottom surface of the substrate.

In still further embodiments, the lower electrode may include sound pressure input holes penetrating the lower electrode, in which a diaphragm gap may be provided between the lower electrode and the diaphragm, and the diaphragm gap may be connected to the acoustic chamber through the sound pressure input holes.

In other embodiments of the present invention, acoustic sensor apparatuses include a package substrate, an acoustic sensor disposed on the package substrate and including a substrate including an acoustic chamber, a first hole, and a second hole, penetrating the substrate, a lower electrode pad extended onto a top surface of the substrate while covering a sidewall of the first hole, a diaphragm pad extended onto the top surface of the substrate while covering a sidewall of the second hole, a lower electrode provided on the acoustic chamber and connected to the lower electrode pad, and a diaphragm above the lower electrode while being separated from the lower electrode and connected to the diaphragm pad, and a signal processor mounted on the package substrate.

In some embodiments, the diaphragm may be electrically connected to the package substrate and the signal processor through the diaphragm pad.

In other embodiments, the acoustic sensor apparatus may include a diaphragm connection portion provided in the second hole on a top surface of the package substrate and connected to the diaphragm pad, in which the diaphragm pad may be electrically connected to the package substrate and the signal processor by the diaphragm connection portion.

In still other embodiments, the apparatus may include a lower electrode connection portion provided in the first hole on the top surface of the package substrate and connected to the lower electrode pad, in which the lower electrode pad may be electrically connected to the package substrate and the signal processor by the lower electrode connection portion.

In even other embodiments, the lower electrode pad may be separated from the diaphragm and the diaphragm pad.

In yet other embodiments, the acoustic sensor may further include a supporting film provided in the acoustic chamber and connected to the substrate and a substrate insulating film provided on the supporting film and the top surface of the substrate, in which the lower electrode may be disposed on the substrate insulating film.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1A:
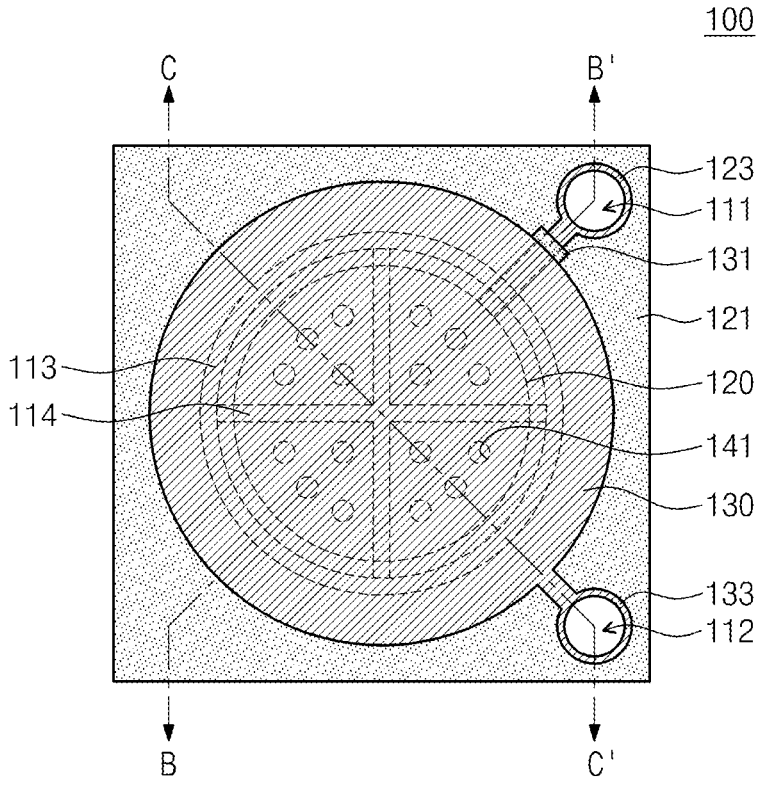
FIG. 1A is a top view of an acoustic sensor according to an embodiment of the present invention.

Exemplary embodiments of the present invention will be described with reference to the attached drawings to allow the construction and effects of the present invention to be fully understood. However, the present invention is not limited to the following embodiments but may be embodied in various shapes and diversely modified. Merely, the embodiments are provided to allow a person with an ordinary skill in the art to perfectly understand the scope of the present invention by explaining the embodiments. Those skilled in the art may understand that in what kind of appropriate environment the inventive concepts may be performed.

Terms used in the specification are to describe the embodiments but not to limit the scope of the present invention. As used herein, the singular forms are intended to include the plural forms as well, unless the context clearly indicates otherwise. The terms "comprises" and/or "comprising" used herein specify the presence of stated components, operations, and/or elements, but do not preclude the presence or addition of one or more other components, operations, and/or elements.

When a layer or film is referred to as being "formed on" another layer or film, it can be directly or indirectly formed on the other layer or film. That is, for example, intervening layers or films may be present.

Although the terms "first", "second", "third", etc. may be used herein to describe various regions, films or layers, these regions, films or layers should not be limited by these terms. These regions, films or layers are only used to distinguish one region, film or layer from another. Accordingly, a membrane mentioned as a first membrane in on embodiment may be mentioned as a second membrane in another embodiment. The respective embodiments described and illustrated herein include complementary ones thereof. Throughout the specification, like reference numerals designate like elements.

Terms used in the embodiments, unless otherwise defined, may be understood as meanings generally known to those skilled in the art.

Hereinafter, the embodiments of the present invention will be described with reference to the attached drawings.

Figure 1B:
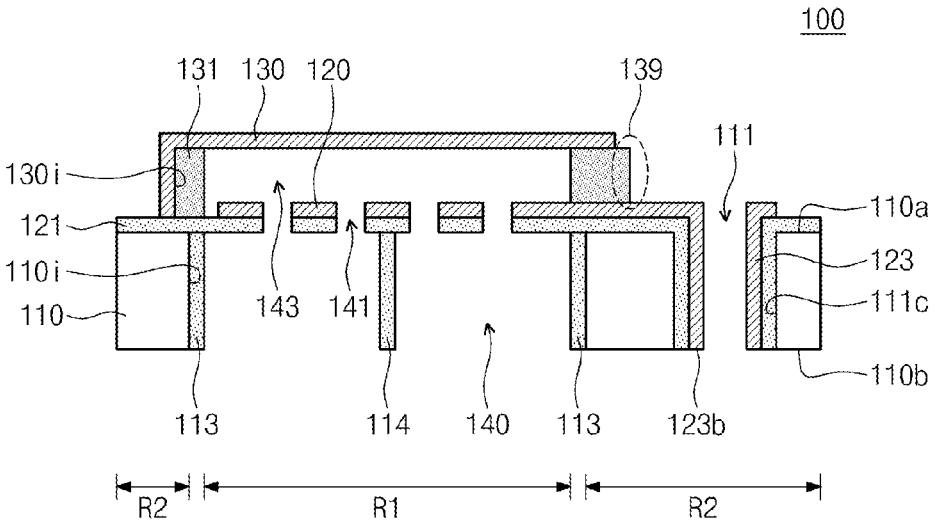
FIG. 1B is a cross-sectional view illustrating a part taken along a line B-B' shown in FIG. 1A.
Figure 1C:
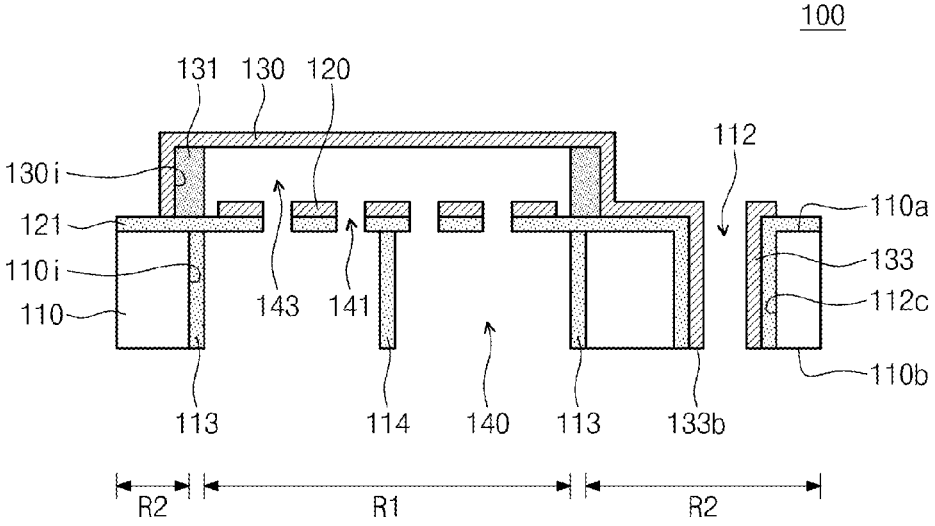
FIG. 1C is a cross-sectional view illustrating a part taken along a line C-C' shown in FIG. 1A.

FIG. 1A is a top view illustrating an acoustic sensor according to an embodiment of the present invention. FIG. 1B is a cross-sectional view illustrating a part taken along a line B-B' shown in FIG. 1A. FIG. 1C is a cross-sectional view illustrating a part taken along a line C-C' shown in FIG. 1A.

Referring to FIGS. 1A to 1C, an acoustic sensor 100 may include a substrate 110, an acoustic chamber 140, sound pressure input holes 141, a diaphragm gap 143, a lower electrode 120, a diaphragm 130, a lower electrode pad 123, and a diaphragm pad 133.

The substrate 110 may be one of a silicon substrate and a compound semiconductor substrate. For example, the substrate 110 may include III-V compound semiconductor materials such as gallium arsenide (GaAs) and indium phosphorus (InP). The substrate 110 may have a thickness of from about 1 μm to about 1000 μm. According thereto, the acoustic sensor 100 may be miniaturized. The substrate 110 may include the acoustic chamber 140, a first hole 111 and second hole 112.

The acoustic chamber 140 may penetrate the substrate 110. A flat protection film 113 may cover an inside surface 110*i* of the substrate 110, in which the acoustic chamber 140 is formed. In a top view, the protection film 113 may have a circular or closed-loop shape. The protection film 113 may have a width of from about 1 μm to about 10 μm and a height of from about 1 μm to about 1000 μm. The protection film 113, compared with the substrate 110, may include a material having etching selectivity, for example, an oxide and organic material. A supporting film 114 may be provided in the acoustic chamber 140. In a top view, the supporting film 114 may have a cross shape. The supporting film 114 may be connected to the protection film 113. According thereto, a substrate insulating film 121 and the lower electrode 120 may be stably fixed to the substrate 110 by the supporting film 114. The supporting film 114 may have a width of from about 1 μm to about 10 μm and a height of from about 1 μm to about 1000 μm. The supporting film 114, compared with the substrate 110, may include a material having etching selectivity, for example, an oxide and organic material. The supporting film 114 may have same material as the protection film 113.

The substrate insulating film 121 may cover a top surface 110*a* of the substrate 110. The lower electrode 120 may be disposed on the supporting film 114 and acoustic chamber 140. The substrate insulating film 121 may include one of an organic material and oxide.

The lower electrode 120 may be provided on the acoustic chamber 140. The lower electrode 120 may include a conductive material, for example, metal. The lower electrode 120 may be stably fixed to the substrate 110 by the supporting film 114 and the substrate insulating film 121. The lower electrode 120 may be insulated from the substrate 110 by the substrate insulating film 121. The sound pressure input holes 141 may be provided penetrating the substrate insulating film 121 and lower electrode 120. The sound pressure input holes 141 may be connected to the acoustic chamber 140.

The first hole 111 and second hole 112 may penetrate from the top surface 110*a* to a bottom surface 110*b* of the substrate 110. As shown in FIG. 1B, the lower electrode pad 123 may cover a sidewall 111*c* of the first hole 111. The lower electrode pad 123 may be extended toward the top surface 110*a* of the substrate 110 to be connected to the lower electrode 120. The lower electrode 120 may form a single structure together with the lower electrode pad 123. For example, the lower electrode pad 123 may include same material as the lower electrode 120. The lower electrode pad 123 may have same thickness as the lower electrode 120.

The diaphragm 130 may be disposed on the top surface 110*a* of the substrate 110 while being separated from the lower electrode 120. The diaphragm gap 143 may be provided between the lower electrode 120 and diaphragm 130. The diaphragm gap 143 may be connected to the sound pressure input holes 141. A sacrificial layer 131 may be provided on an inside wall 130*i* of the diaphragm 130. The sacrificial layer 131 may be disposed between the substrate insulating film 121 and diaphragm 130. The sacrificial layer 131 may include one of amorphous silicon and an organic material. As shown in FIG. 1B, the sacrificial layer 131 may be extended between the lower electrode pad 123 and diaphragm 130. According thereto, the diaphragm 130 may be electrically insulated from the lower electrode pad 123. In a top view, the diaphragm 130 may have a circular shape. The diaphragm 130 may function as a counter electrode of the lower electrode 120. The diaphragm 130 may include a conductive material, for example, metal. External sound pressure may be transferred to the diaphragm 130 through the acoustic chamber 140, sound pressure input holes 141, and the diaphragm gap 143. The diaphragm 130 may be vibrated due to the transferred external sound pressure. In this case, the lower electrode 120 may not be vibrated due to the substrate insulating film 121 and supporting film 114. According thereto, the acoustic sensor 100 may reduce noises and may have excellent frequency characteristics. The sacrificial layer 131 may fix the diaphragm 130 to the substrate insulating film 121 in order to prevent the diaphragm 130 from being vibrated due to an undesirable external sound pressure.

As shown in FIG. 1C, the diaphragm pad 133 may cover a sidewall 112*c* of the second hole 112. The diaphragm pad 133 may be extended toward the top surface 110*a* of the substrate 110 to be connected to the diaphragm 130. The diaphragm 130 may form a single structure together with the diaphragm pad 133. For example, the diaphragm 133 may include same material as the diaphragm 130.

As an example, the diaphragm 130 and diaphragm pad 133 may have one of a single layer structure formed of a conductive layer and a multilayer structure formed of a conductive layer and insulating film. The diaphragm 130 and diaphragm pad 133 may have a thickness of from about 1 μm to about 20 μm. The diaphragm 133 may be separated from the lower electrode pad 123. The substrate insulating film 121 may be extended from the top surface 110*a* of the substrate 110 to sidewalls of holes. The substrate insulating film 121 may be disposed between the substrate 110 and lower electrode pad 123 and between the substrate 110 and diaphragm pad 133, respectively. The respective pads 123 and 133 may be electrically insulated from the substrate 110 by the substrate insulating film 121.

FIGS. 2A, 3A, 4A, 5A, 6A, and 7A are top views of a process of manufacturing the acoustic sensor according to an embodiment of the present invention. FIGS. 2B, 3B, 4B, 5B, 6B, and 7B are cross-sectional views illustrating parts taken along lines B-B' shown in FIGS. 2A, 3A, 4A, 5A, 6A, and 7A, respectively. FIGS. 4C, 5C, 6C, and 7C are cross-sectional views illustrating parts taken along lines C-C' shown in FIGS. 4A, 5A, 6A, and 7A, respectively. Hereinafter, a repetitive description of the described above will be omitted.

Figure 2A:
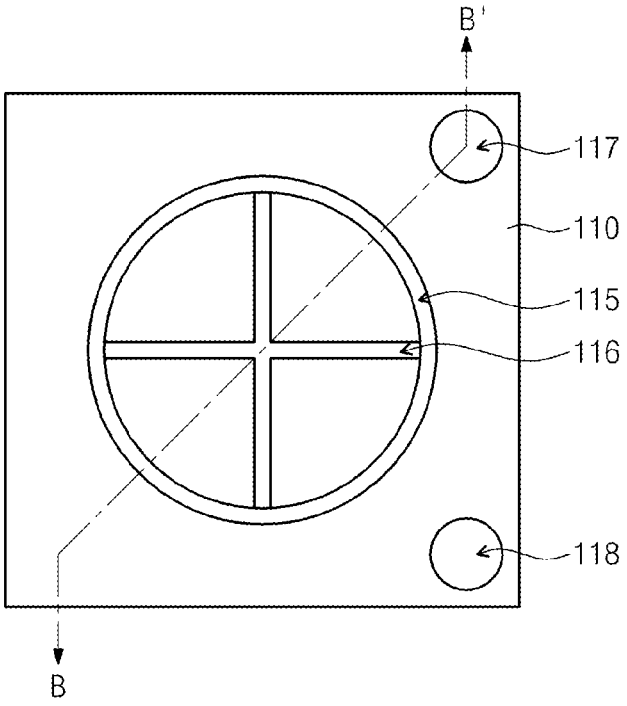
FIGS. 2A, 3A, 4A, 5A, 6A, and 7A are top views of a process of manufacturing the acoustic sensor according to an embodiment of the present invention.
Figure 2B:
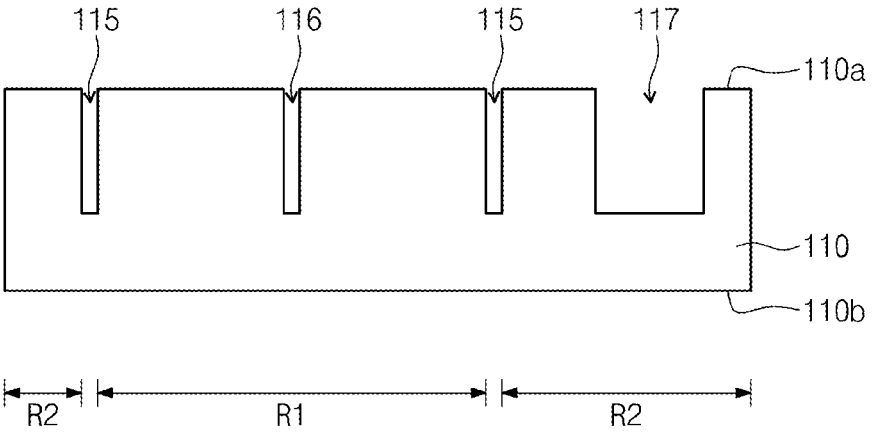
FIGS. 2B, 3B, 4B, 5B, 6B, and 7B are cross-sectional views illustrating parts taken along lines B-B' shown in FIGS. 2A, 3A, 4A, 5A, 6A, and 7A, respectively.

Referring to FIGS. 2A and 2B, the substrate 110 including a protection film groove 115, a supporting film groove 116, a first groove 117, and a second groove 118 may be provided. The substrate 110 may include identical or similar material to the described with reference to FIGS. 1A to 1C. The substrate 110 may be etched, thereby forming the protection film groove 115, the supporting film groove 116, the first groove 117, and the second groove 118 on the top surface 110*a* of the substrate 110. The grooves 115, 116, 117, and 118 may be recessed from the top surface 110*a* toward the bottom surface 110*b* of the substrate 110. The grooves 115, 116, 117, and 118 may not penetrate the bottom surface 110*b* of the substrate 110. The grooves 115, 116, 117, and 118 may be formed using the same etching process. Differently, the grooves 115, 116, 117, and 118 may be formed using a different etching process from one another. In a top view, the protection film groove 115 may have a circular or closed-loop shape. A chamber region R1 and supporting region R2 may be defined by the protection film groove 115. The chamber region R1 may correspond to an inside of the protection film groove 115 in the substrate 110. The supporting region R2 may correspond to an outside of the protection film groove 115. The protection film groove 115 may have a width of from about 1 μm to about 10 μm. The protection film groove 115 may have a depth of from about 10 μm to about 1000 μm. The supporting film groove 116 may be connected to the protection film groove 115. In a top view, the supporting film groove 116 may have a cross shape. The supporting film groove 116 may be formed in the chamber region R1. The supporting film groove 116 may have a width of from about 1 μm to about 10 μm. The supporting film groove 116 may have a depth of from about 10 μm to about 100 μm. The first groove 117 and second groove 118 may be disposed more adjacently to a corner of the substrate 110 than the protection film groove 115. In a top view, the first groove 117 and second groove 118 may have a circular or quadrilateral shape. A pad groove may have a width of from about 1 μm to about 100 μm. The first groove 117 and second groove 118 may have depths of from about 10 μm to about 1000 μm, respectively.

Figure 3A:
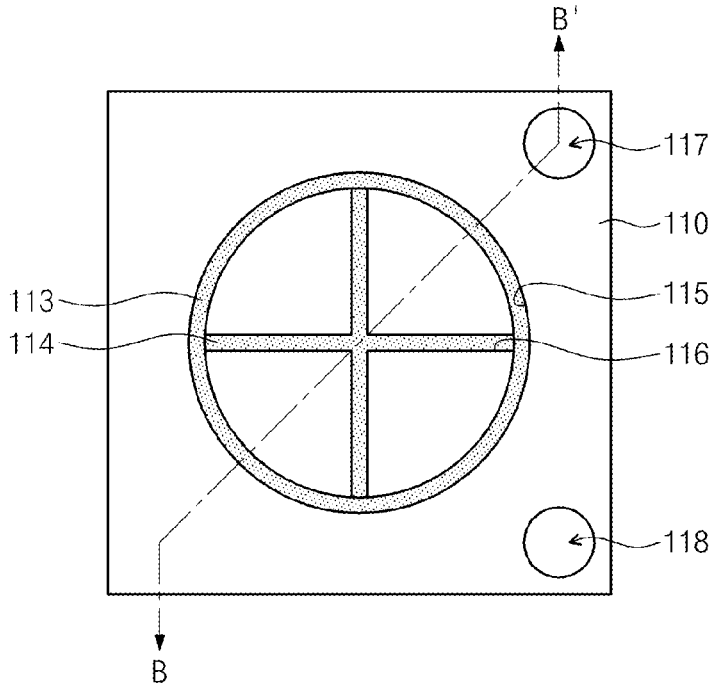
Figure 3B:
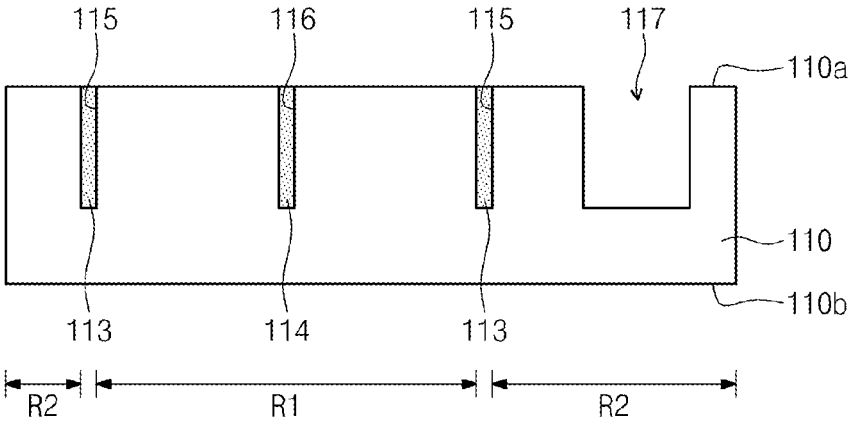

Referring to FIGS. 3A and 3B, a protection film 113 and a supporting film 114 may be formed in the protection film groove 115 and the supporting film groove 116 of the substrate 110, respectively. As an example, an insulating film (not shown) may be formed on the substrate 110. In this case, the insulating film may not be formed in the first groove 117 and second groove. The insulating film may be planarized, and the protection film 113 and the supporting film 114 may be formed. The planarization of the insulating film may be performed using one of chemical mechanical polishing (CMP) and an etching process. According thereto, the top surface 110*a* of the substrate 110 may be exposed and the protection film 113 and the supporting film 114 may be separated. The protection film 113 and the supporting film 114 may be formed using the same process. The protection film 113 may include same material as the supporting film 114, for example, an oxide.

Figure 4A:
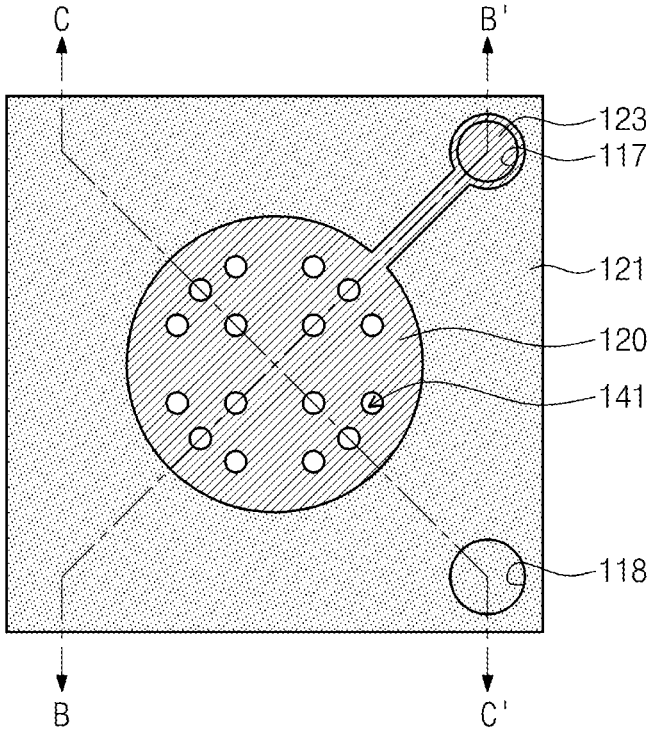
Figure 4B:
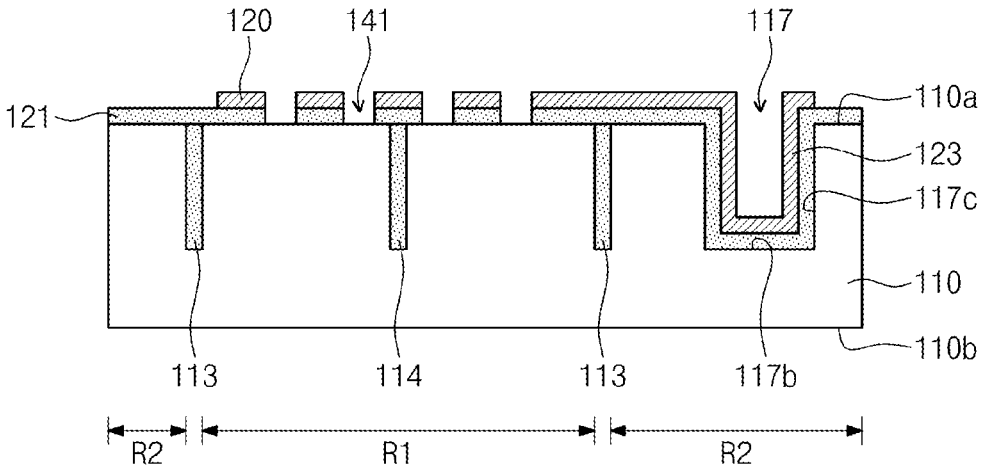
Figure 4C:
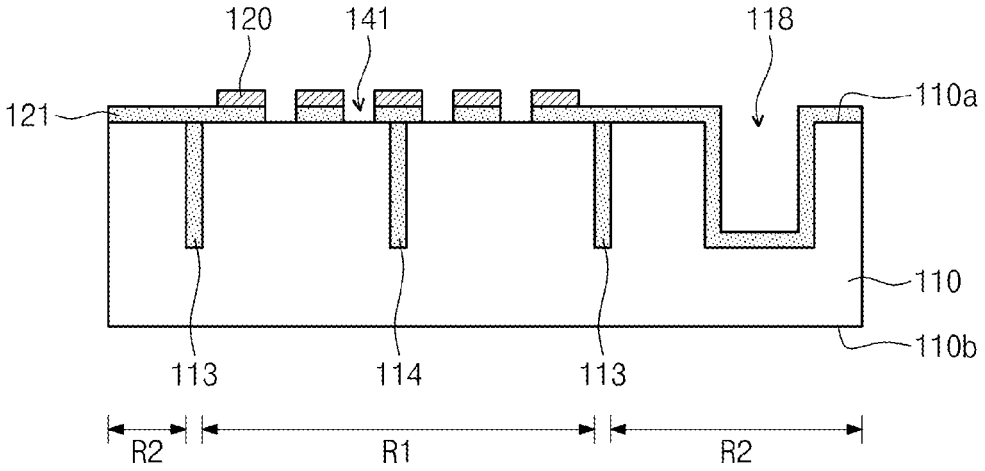
FIGS. 4C, 5C, 6C, and 7C are cross-sectional views illustrating parts taken along lines C-C' shown in FIGS. 4A, 5A, 6A, and 7A, respectively.

Referring to FIGS. 4A to 4C, the substrate insulating film 121, lower electrode 120, and lower electrode pad 123 may be formed. For example, the substrate insulating film 121, on the top surface 110*a* of the substrate 110, may cover the protection film 113 and the supporting film 114. The substrate insulating film 121 may cover sidewalls and bottom surfaces of the first and second grooves 117 and 118. The lower electrode 120 may be formed on the substrate insulating film 121 in the chamber region R1 of the substrate 110. The lower electrode 120 may be connected to the lower electrode pad 123. The lower electrode pad 123 may cover a bottom surface 117*b* and sidewall 117*c* of the first groove 117. The sound pressure input holes 141 may be formed to penetrate the lower electrode 120 and substrate insulating film 121. The sound pressure input holes 141 may expose the top surface 110*a* of the substrate 110. The lower electrode 120 and the lower electrode pad 123 may be formed at the same time. For example, a conductive film (not shown) may be formed to cover the substrate insulating film 121. The conductive film may be patterned, and the lower electrode pad 123 and lower electrode 120 may be formed.

Figure 5A:
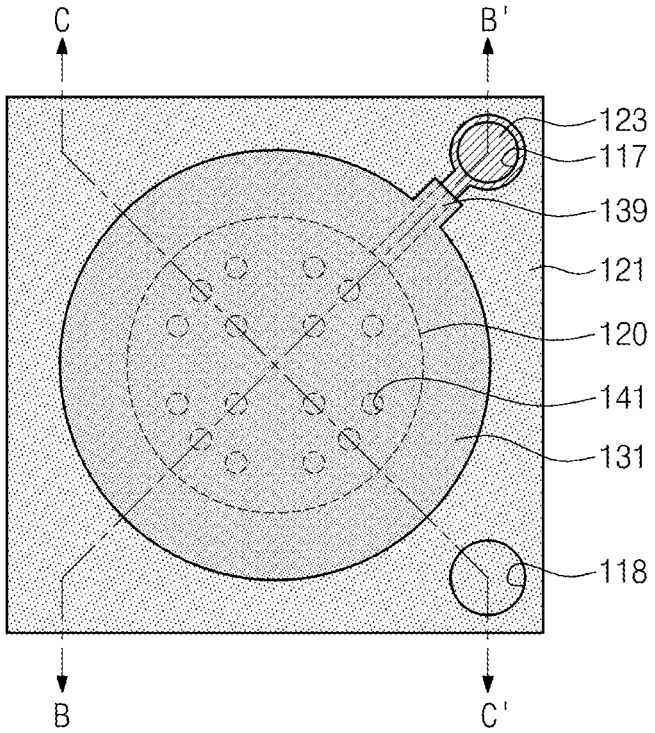
Figure 5B:
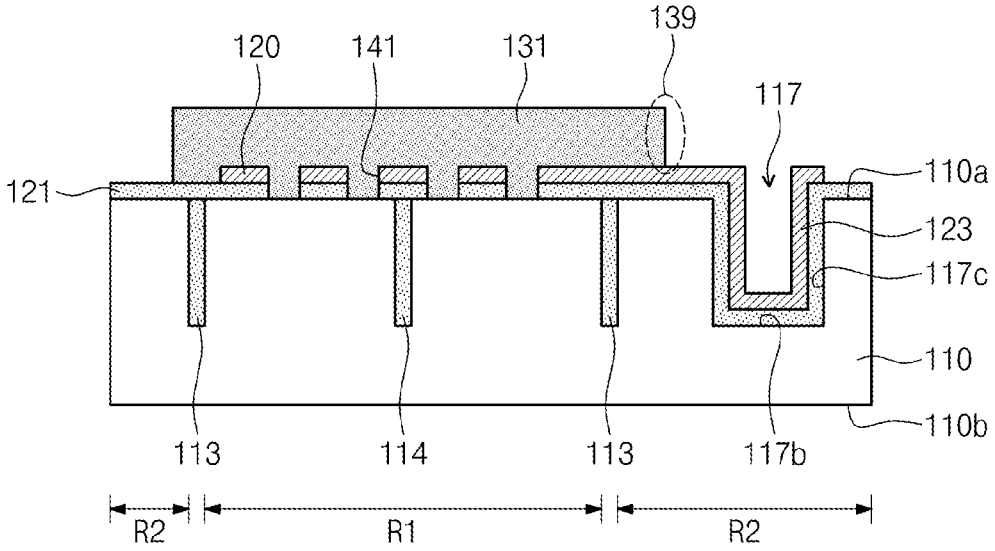
Figure 5C:
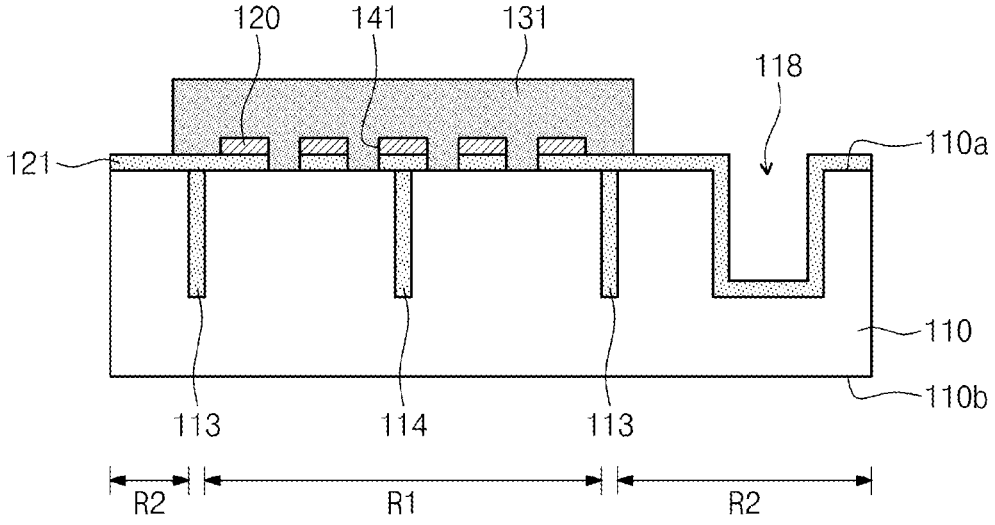

Referring to FIGS. 5A to 5C, the sacrificial layer 131 may be formed on the top surface 110*a* of the substrate 110. The sacrificial layer 131 may be formed in the chamber region R1 of the substrate 110. The sacrificial layer 131 may be provided on the substrate insulating film 121 and lower electrode 120 and may fill holes. In a top view, the sacrificial layer 131 may have a circular shape. The sacrificial layer 131 may include an extension portion 139. The extension portion 139 of the sacrificial layer 131 may be extended onto the lower electrode pad 123 and may cover at least a part of the lower electrode pad 123. The sacrificial layer 131 may include a material having etching selectivity different from the substrate insulating film 121. The sacrificial layer 131 may include one of an oxide and organic material. The sacrificial layer 131 may have a thickness of from about 1 μm to about 20 μm.

Figure 6A:
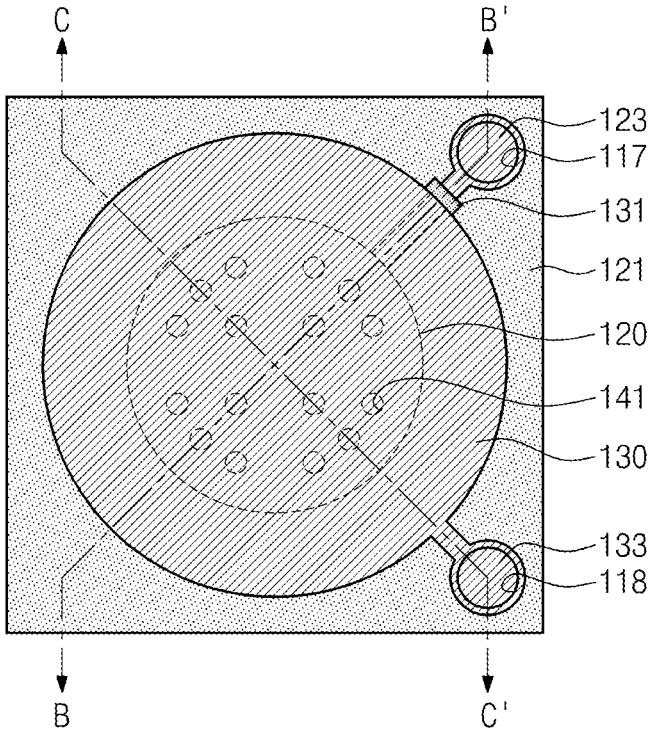
Figure 6B:
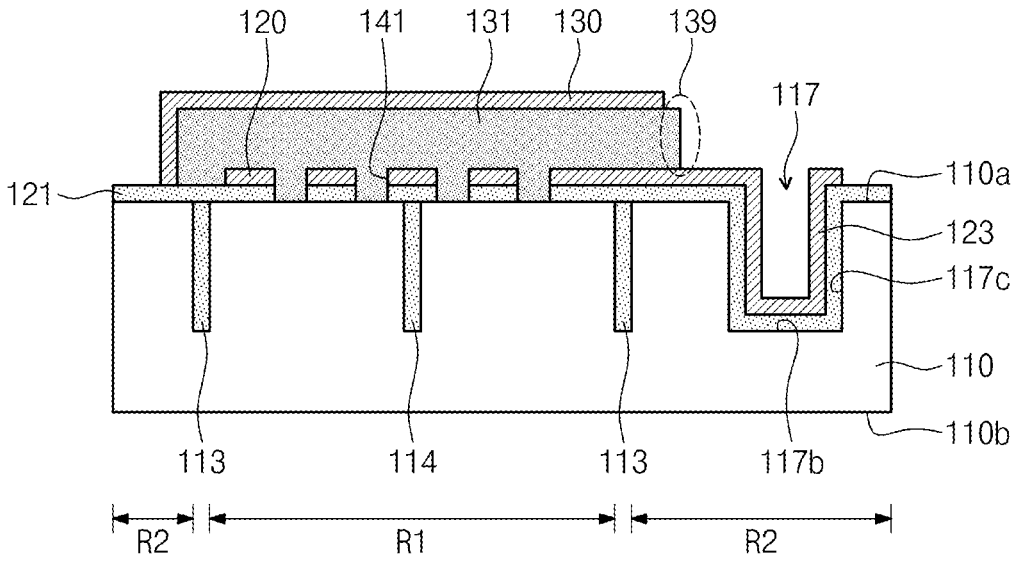
Figure 6C:
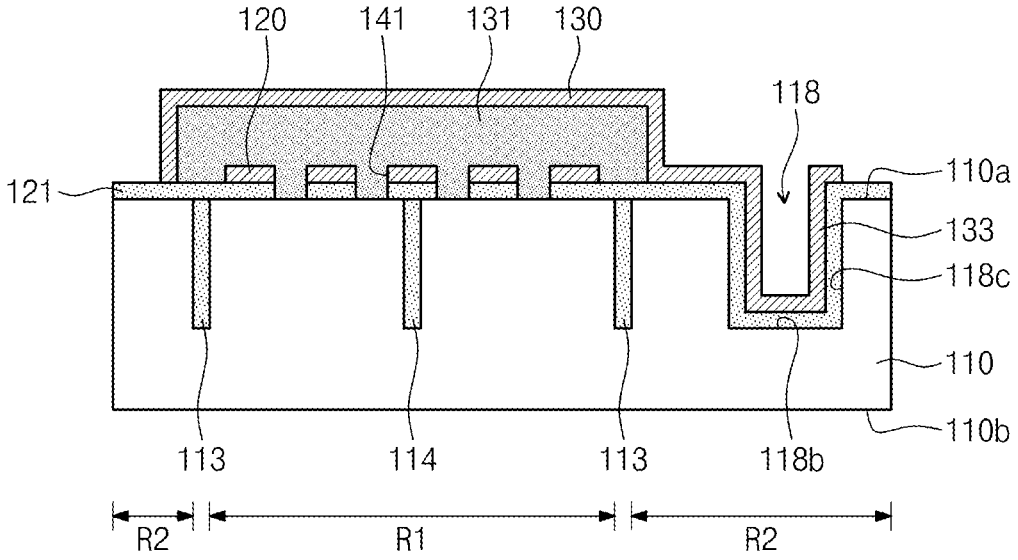

Referring to FIGS. 6A to 6C, the diaphragm 130 and diaphragm pad 133 may be formed on the substrate 110. The diaphragm 130 and diaphragm pad 133 may be formed using the same process. The diaphragm 130 may form a single structure together with the diaphragm pad 133. For example, a conductive film (not shown) may be formed on the substrate 110. The conductive film may be applied onto a top surface and sidewall of the sacrificial layer 131, the top surface 110*a* of the substrate 110, and the bottom surface 118*b* and sidewall 118*c* of the second groove 118. The diaphragm 130 and diaphragm pad 133 connected to the diaphragm 130 may be formed by pattering the conductive layer. The patterning of the conductive layer may be performed using a photolithography process and etching process. The diaphragm 130 may include the same conductive material as the diaphragm pad 133. For example, the diaphragm 130 may include the same metal as the diaphragm pad 133. The diaphragm 130 may be formed in the chamber region R1. The diaphragm 130 may be extended onto the top surface 110*a* of the substrate 110. The diaphragm 130 may cover the top surface and sidewall of the sacrificial layer 131. The diaphragm 130 may be separated from the lower electrode 120 by the sacrificial layer 131. The diaphragm 130 may be separated from the lower electrode pad 123 by the extension portion 139 of the sacrificial layer 131. The diaphragm pad 133 may cover a bottom surface 118*b* and side surface 118*c* of the second groove 118, The diaphragm pad 133 may be extended onto the top surface 110*a* of the substrate 110.

Figure 7A:
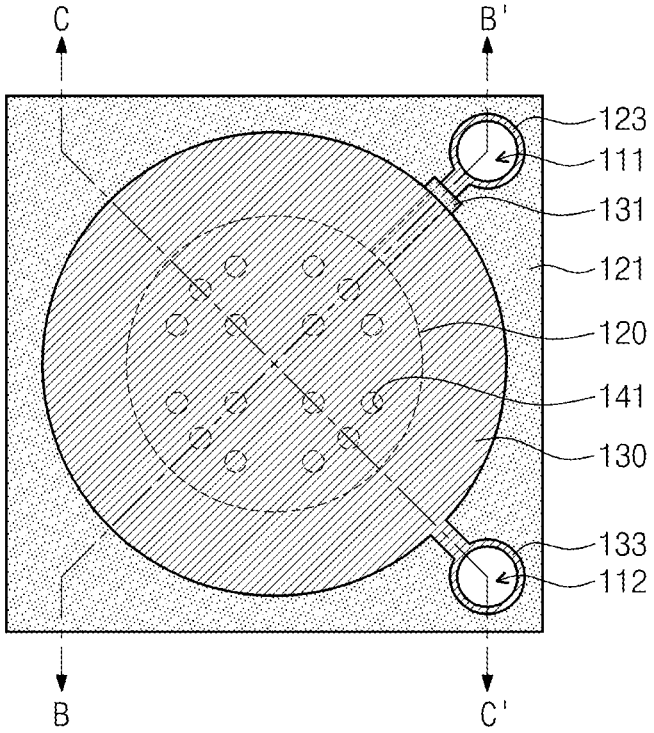
Figure 7B:
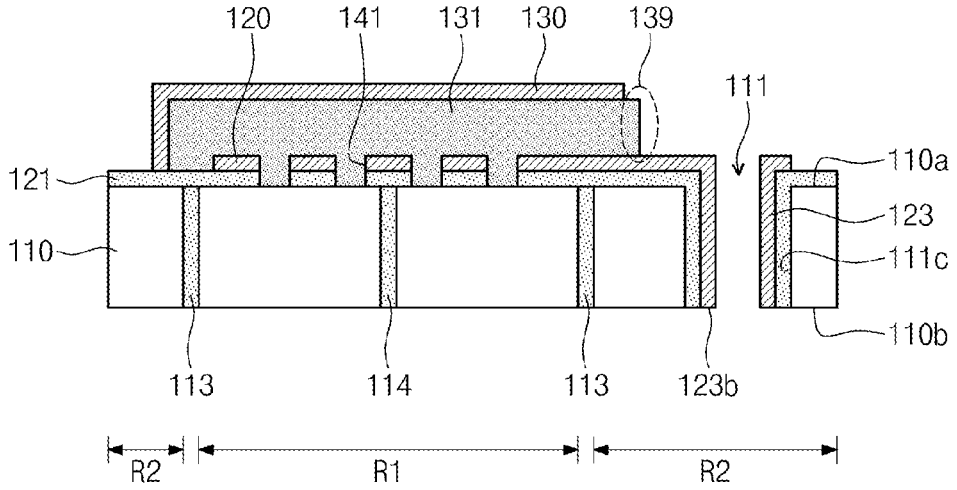
Figure 7C:
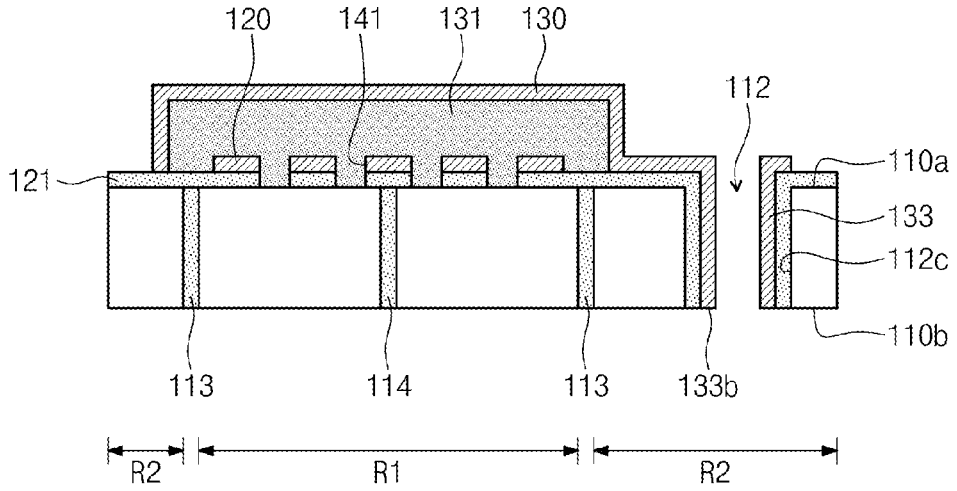

Referring to FIGS. 7A to 7C, the bottom surface 110*b* of the substrate 110 is planarized, thereby exposing the substrate insulating film 121, the protection film 113, the supporting film 114, the lower electrode 120, and the pads 123 and 133 on the bottom surface 110*b* of the substrate 110. A first hole 111 and a second hole 112 may be formed by the planarization of the bottom surface 110*b* of the substrate 110. For example, the planarization of the bottom surface 110*b* of the substrate 110 may be performed using one of overall etching and CMP. The bottom surface 110*b* may be planarized until the substrate insulating film 121, supporting film 114, lower electrode 120, lower electrode pad 123, and diaphragm pad 133 are exposed. For example, a lowest surface 123*b* of the lower electrode pad 123 and a lowest surface 133*b* of the diaphragm pad 133 may form a coplanar together with the bottom surface 110*b* of the substrate 110. As the bottom surface 110*b* of the substrate 110 is planarized, the thickness of the substrate 110 may be reduced. For example, the substrate 110 may have a thickness of from about 1 μm to about 1000 μm.

Referring to FIGS. 1A to 1C, the acoustic chamber 140, sound pressure input holes 141, and diaphragm gap 143 may be formed in the substrate 110. The acoustic chamber 140, sound pressure input holes 141, and diaphragm gap 143 may be identical or similar to the described above with reference to FIGS. 1A to 1C. For example, the chamber region R1 of the substrate 110 may be etched. In this case, a mask film (not shown) may be formed on a bottom surface of the supporting region R2 of the substrate 110. As an example, when the substrate 110 includes silicon, a dry-etching process using a fluorine gas, for example, $XeF_2$ gas may be performed. The chamber region R1 of the substrate 110 is removed by etching, thereby forming the acoustic chamber 140. The protection film 113 may prevent an etching solution or etching gas from flowing into the supporting region R2 of the substrate 110. According thereto, the supporting region R2 of the substrate 110 may not be removed by the etching process. As the chamber region R1 of the substrate 110 is etched, a bottom surface of the substrate insulating film 121 and the sacrificial layer 131 in a hole may be exposed. The sacrificial layer 131 may be removed by dry etching. A gas used in the etching process may vary with a kind of a material included in the sacrificial layer 131. As an example, when the sacrificial layer 131 includes amorphous silicon, the sacrificial layer 131 may be removed by an etching process using a fluorine gas. In this case, the chamber region R1 of the substrate 110 and sacrificial layer 131 may be removed using the same etching process. As another example, when the sacrificial layer 131 includes an organic material, the sacrificial layer 131 may be etched using an oxygen gas. An etching gas may flow through the acoustic chamber 140 and react with the sacrificial layer 131. The sacrificial layer 131 reacting with the etching gas may be removed outward through the acoustic chamber 140. According thereto, the sound pressure input holes 141 and diaphragm gap 143 may be formed. As an example, a part of the sacrificial layer 131 may not be removed. The sacrificial layer 131 may remain on the inside wall 130*i* of the diaphragm 130. The sacrificial layer 131 may remain between the lower electrode pad 123 and diaphragm 130.

Figure 8A:
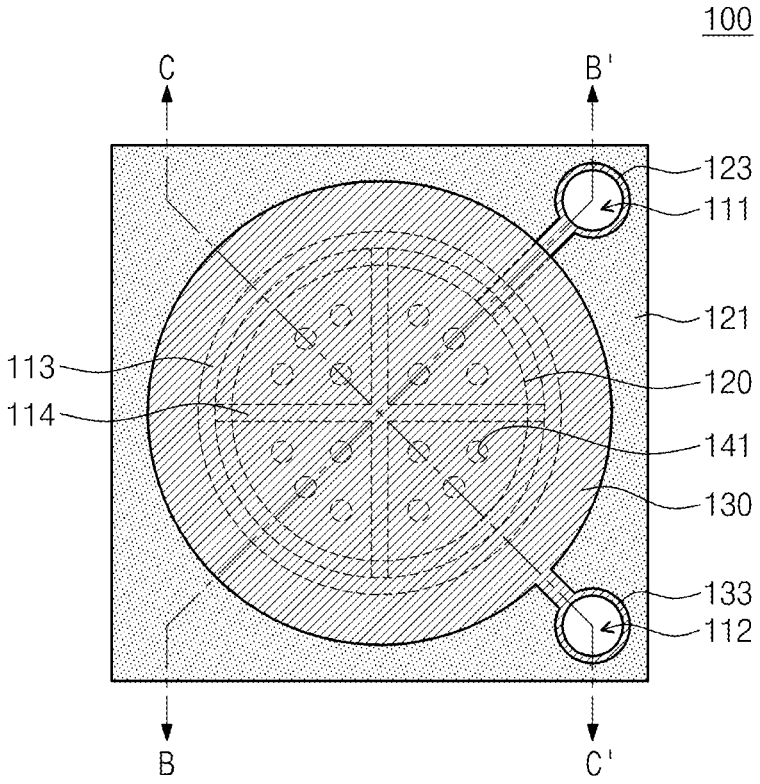
FIG. 8A is a top view illustrating an acoustic sensor according to another embodiment of the present invention.
Figure 8B:
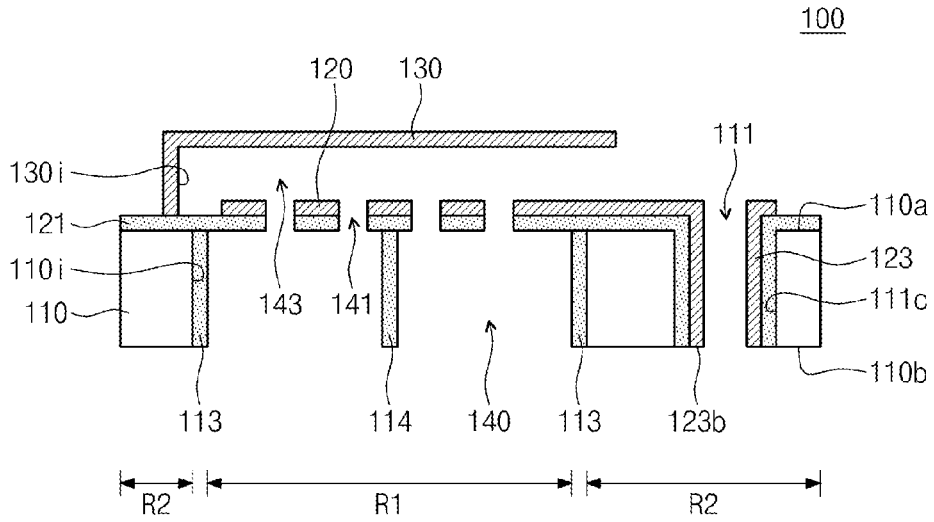
FIG. 8B is a cross-sectional view illustrating a part taken along a line B-B' shown in FIG. 8A.
Figure 8C:
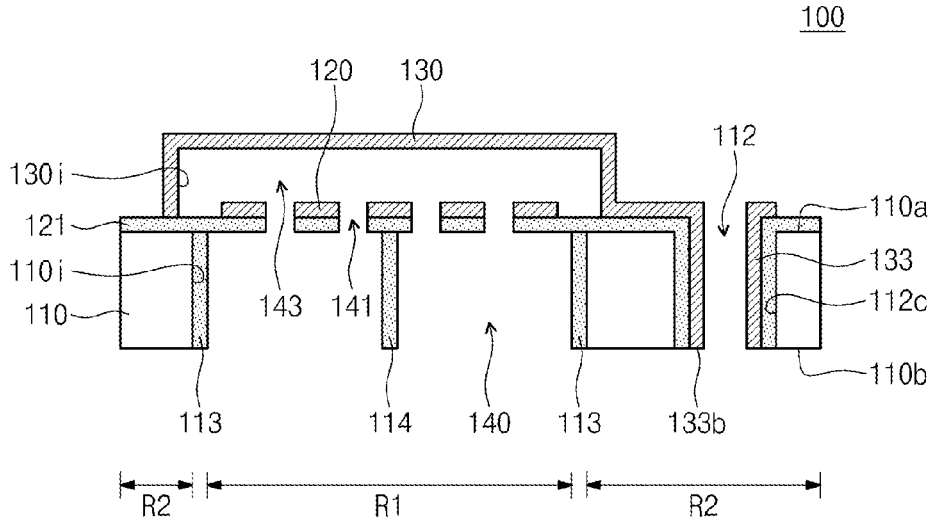
FIG. 8C is a cross-sectional view illustrating a part taken along a line C-C' shown in FIG. 8A.

FIG. 8A is a top view illustrating the acoustic sensor 100 according to another embodiment of the present invention. FIG. 8B is a cross-sectional view illustrating a part taken along a line B-B' shown in FIG. 8A. FIG. 8C is a cross-sectional view illustrating a part taken along a line C-C' shown in FIG. 8A.

Referring to FIGS. 8A to 8C, the acoustic sensor 100 may include the substrate 110, acoustic chamber 140, sound pressure input holes 141, diaphragm gap 143, lower electrode 120, diaphragm 130, lower electrode pad 123, and diaphragm pad 133.

The substrate 110, acoustic chamber 140, sound pressure input holes 141, diaphragm gap 143, lower electrode 120, diaphragm 130, lower electrode pad 123, and diaphragm pad 133 may identical or similar to the described above with reference to FIGS. 1A to 1C. For example, the lower electrode 120 may be provided on the acoustic chamber 140. The lower electrode 120 may be stably fixed to the substrate 110 by the supporting film 114 and substrate insulating film 121. The sound pressure input holes 141 may be provided penetrating the substrate insulating film 121 and lower electrode 120.

As shown in FIG. 8B, the lower electrode pad 123 may cover the sidewall 111*c* of the first hole 111. The lower electrode pad 123 may be extended onto the top surface 110*a* of the substrate 110 to be connected to the lower electrode 120. The lower electrode 120 may form a single structure together with the lower electrode pad 123. The diaphragm 130 may be disposed on the top surface 110*a* of the substrate 110 while being separated from the lower electrode 120. The diaphragm gap 143 may be provided between the lower electrode 120 and diaphragm 130. The diaphragm gap 143 may be connected to the sound pressure input holes 141. Differing from FIGS. 1A to 1C, the sacrificial layer 131 may not remain. In this case, an air gap may be formed between the diaphragm 130 and the lower electrode pad 123. According thereto, the diaphragm 130 may be separated from the lower electrode pad 123.

As shown in FIG. 8C, the diaphragm pad 133 may cover the sidewall 112*c* of the second hole 112. The diaphragm pad 133 may be extended onto the top surface 110*a* of the substrate 110 to be connected to the diaphragm 130. The diaphragm 130 may form a single structure together with the diaphragm pad 133. The substrate insulating film 121 may be disposed between the substrate 110 and lower electrode pad 123 and between the substrate 110 and diaphragm pad 133, respectively. The respective pads 123 and 133 may be electrically insulated from the substrate 110 by the substrate insulating film 121.

Figure 9A:
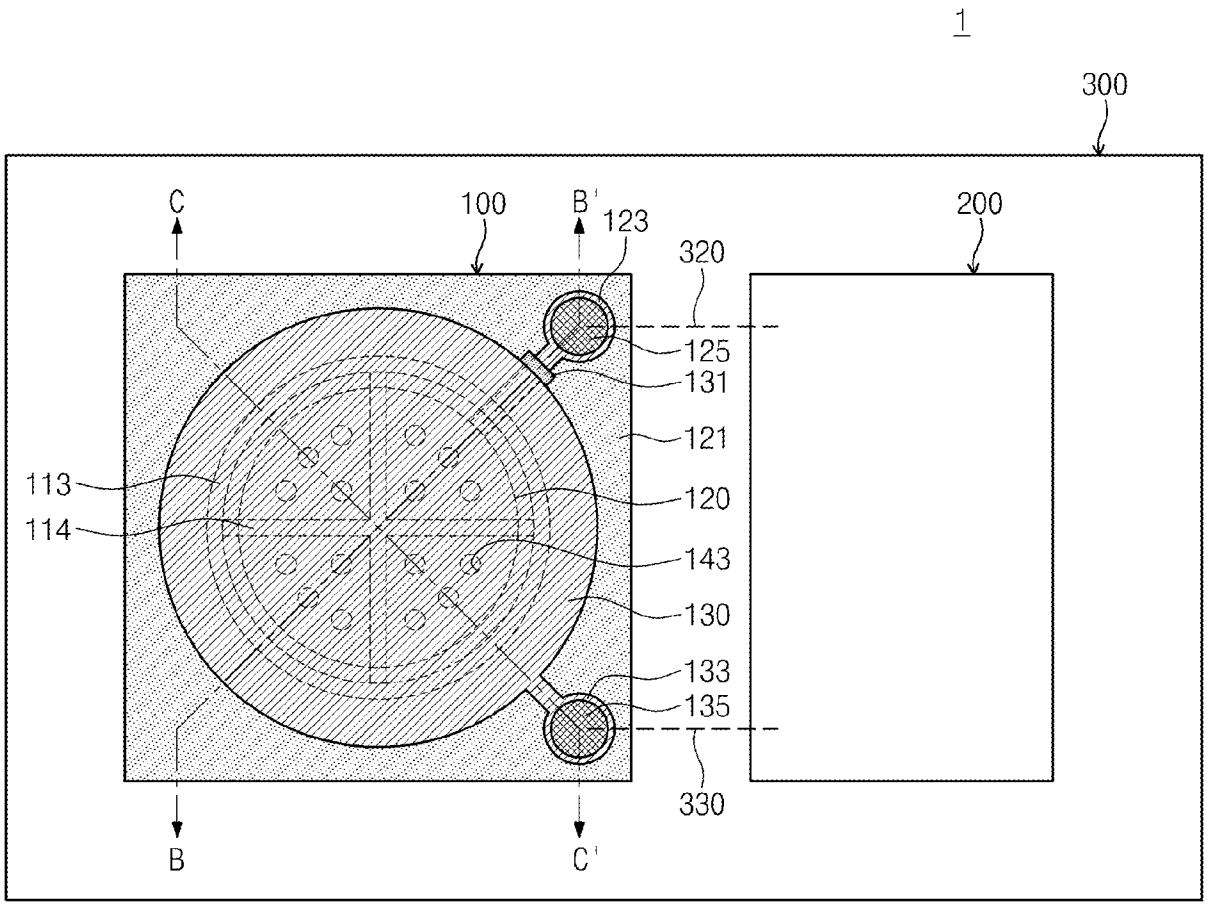
FIG. 9A is a cross sectional view illustrating an acoustic sensor apparatus according to an embodiment of the present invention.
Figure 9B:
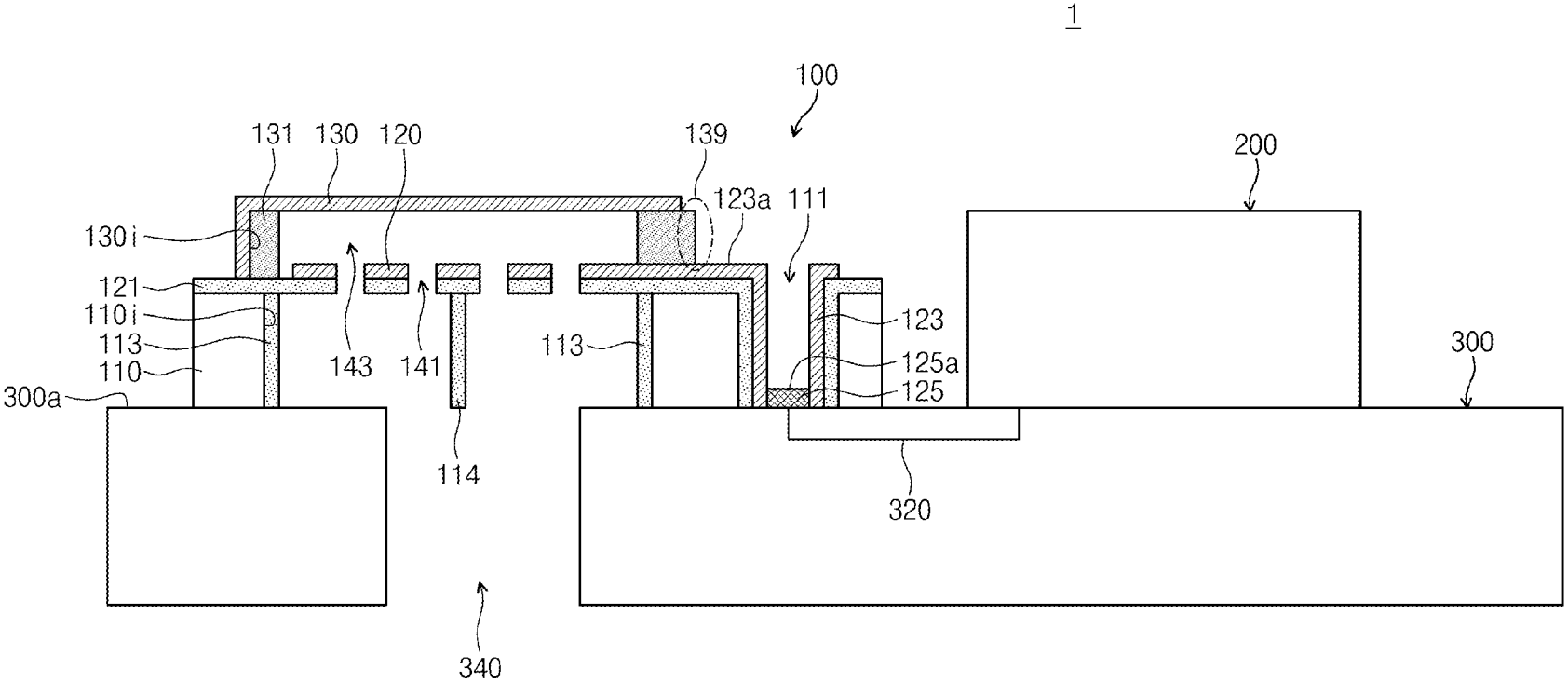
FIG. 9B is a cross-sectional view illustrating a part taken along a line B-B' shown in FIG. 9A.
Figure 9C:
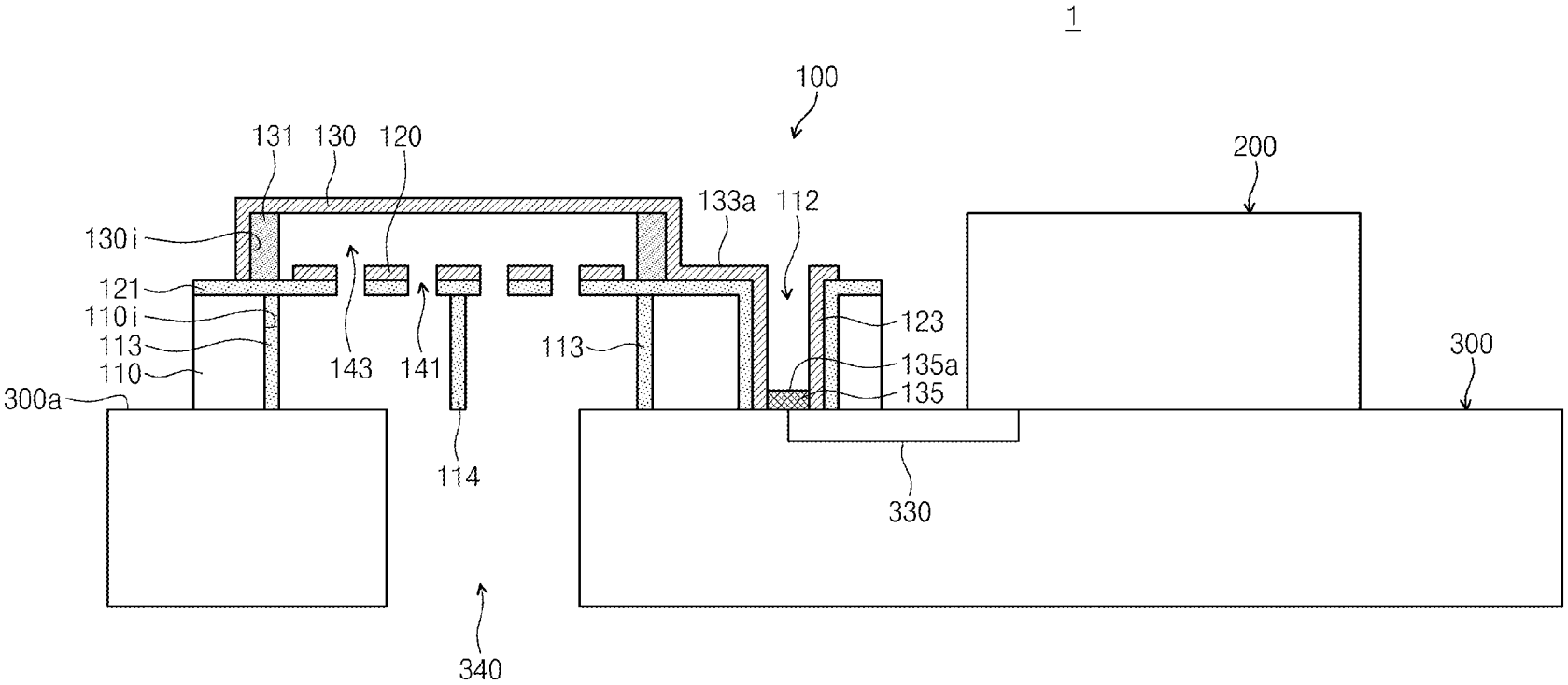
FIG. 9C is a cross-sectional view illustrating a part taken along a line C-C' shown in FIG. 9A.

FIG. 9A is a cross sectional view illustrating an acoustic sensor apparatus according to an embodiment of the present invention. FIG. 9B is a cross-sectional view illustrating a part taken along a line B-B' shown in FIG. 9A. FIG. 9C is a cross-sectional view illustrating a part taken along a line C-C' shown in FIG. 9A.

Referring to FIGS. 9A to 9C, an acoustic sensor apparatus may include a package substrate 300, the acoustic sensor 100, and a signal circuit unit 200.

The package substrate 300 may be a printed circuit board (PCB) having a circuit pattern. The acoustic sensor 100 and signal circuit unit 200 may be mounted on the package substrate 300, respectively. A sound pressure transfer hole 340 may be formed in the package substrate 300. The sound pressure transfer hole 340 may be connected to the acoustic chamber 140. External sound pressure may be transferred to the acoustic chamber 140 through the sound pressure transfer hole 340.

Examples of the acoustic sensor 100 have been described with reference to FIGS. 1A to 1C and 8A to 8C. The acoustic sensor 100 may include the substrate 110, protection film 113, supporting film 114, substrate insulating film 121, acoustic chamber 140, sound pressure input holes 141, diaphragm gap 143, lower electrode 120, diaphragm 130, and pads 123 and 133.

The lower electrode 120 may be provided on the substrate insulating film 121. The lower electrode pad 123 may cover the sidewall 111*c* of the first hole 111. The lower electrode pad 123 may be extended onto the top surface 110*a* of the substrate 110 to be connected to the lower electrode 120. The sacrificial layer 131 is provided between the lower electrode pad 123 and diaphragm 130, thereby electrically insulating the lower electrode pad 123 from the diaphragm 130. Differently, as described with reference to FIGS. 8A to 8C, the air gap may be provided between the lower electrode pad 123 and diaphragm 130.

A lower electrode connection portion 125 may be provided in the first hole 111 on a top surface of the package substrate 300. For example, the first hole 111 is filled with a conductive material, thereby forming the lower electrode connection portion 125. A top surface 125*a* of the lower electrode connection portion 125 may have a level identical to or lower than a highest surface 123*a* of the lower electrode pad 123. The lower electrode connection portion 125 may be connected to the lower electrode pad 123. The lower electrode 120 may be electrically connected to one of the package substrate 300 and signal circuit unit 200 through the lower electrode pad 123, lower electrode connection portion 125, and a first connection portion 320.

The diaphragm 130 may be separated from the lower electrode 120. The diaphragm pad 133 may cover the sidewall 112*c* of the second hole 112. The diaphragm pad 133 may be extended onto the top surface 110*a* of the substrate 110 to be connected to the diaphragm 130. A diaphragm connection portion 135 may be formed on a top surface 300*a* of the package substrate 300 in the second hole 112. The diaphragm connection portion 135 may be connected to the diaphragm pad 133. For example, the second hole 112 is filled with a conductive material, thereby forming the diaphragm connection portion 135. A top surface 135*a* of the diaphragm connection portion 135 may have a level identical to or lower than a highest surface 133*a* of the diaphragm pad 133. The diaphragm 130 may be electrically connected to one of the package substrate 300 and signal circuit unit 200 through the diaphragm pad 133, diaphragm connection portion 135, and a second connection portion 330. The first connection portion 320 and second connection portion 330 may be wirings formed in the package substrate 300. As another example, the first connection portion 320 and second connection portion 330 may be one of the wirings and pads on the package substrate 300 but are not limited thereto and may be various.

As the pads 123 and 133 and connection portions 125 and 135 are provided, a bonding wire (not shown) may not be formed on the top surface 110*a* of the substrate 110. According thereto, a height of the acoustic sensor 100 may be reduced. According to the embodiments, the acoustic sensor 100 may be miniaturized.

According to the inventive concepts, a lower electrode pad may cover a sidewall of a first hole and a diaphragm pad may cover a sidewall of a second hole. The lower electrode pad may be extended onto a top surface of a substrate and may be connected to a lower electrode. The diaphragm pad may be extended onto the top surface of the substrate and may be connected to a diaphragm. An acoustic sensor may be electrically connected to a package substrate and signal circuit unit by pads. The acoustic sensor does not include a bonding wire and may be miniaturized.

According to the method of manufacturing the acoustic sensor, the substrate may be planarized. Accordingly, the acoustic sensor may be more miniaturized.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An acoustic sensor comprising:

a substrate comprising an acoustic chamber, a first hole, and a second hole that penetrate the substrate, the first hole being spaced apart from the second hole;

a lower electrode pad including a first portion and a second portion, the first portion disposed on a sidewall of the first hole, the second portion disposed on a top surface of the substrate and extending in a first direction;

a diaphragm pad including a first portion and a second portion, the first portion disposed on a sidewall of the second hole, the second portion disposed on the top surface of the substrate and extending in a second direction;

a lower electrode disposed over the acoustic chamber and connected to the second portion of the lower electrode pad; and a diaphragm disposed over the lower electrode and spaced apart from the lower electrode, the diaphragm being connected to the second portion of the diaphragm pad.

2. The acoustic sensor of claim 1, wherein the diaphragm pad is separated from the lower electrode pad.

3. The acoustic sensor of claim 1, further comprising a sacrificial layer that includes an annular portion and an extension portion, the annular portion disposed along an inner sidewall of the diaphragm, the extension portion protruding from the annular portion and disposed between the second portion of the lower electrode pad and the diaphragm.

4. The acoustic sensor of claim 1, further comprising:

a supporting film disposed in the acoustic chamber and including a first portion and a second portion, the first portion extending in a third direction, the second portion extending in a fourth direction crossing the third direction; and a substrate insulating film disposed on the supporting film and the top surface of the substrate, wherein the substrate insulating film is disposed between the substrate and the lower electrode pad and between the substrate and the diaphragm pad, and wherein the lower electrode is disposed on the substrate insulating film.

5. The acoustic sensor of claim 1, wherein the diaphragm pad comprises the same material as the diaphragm.

6. The acoustic sensor of claim 1, wherein the lower electrode pad comprises the same material as the lower electrode.

7. The acoustic sensor of claim 1, wherein a lowest surface of the first portion of the lower electrode pad and a lowest surface of the first portion of the diaphragm pad are coplanar with a bottom surface of the substrate.

8. The acoustic sensor of claim 1, wherein the lower electrode comprises sound pressure input holes penetrating the lower electrode, wherein a diaphragm gap is provided between the lower electrode and the diaphragm, and wherein the diaphragm gap is connected to the acoustic chamber through the sound pressure input holes.

9. An acoustic sensor apparatus comprising:

a package substrate;

a signal circuit unit mounted on the package substrate; and an acoustic sensor disposed on the package substrate and comprising:

a substrate having an acoustic chamber, a first hole, and a second hole that penetrate the substrate, the first hole being spaced apart from the second hole;

a lower electrode disposed over the acoustic chamber;

a diaphragm disposed over the lower electrode and being spaced apart from the lower electrode;

a lower electrode pad including a first portion and a second portion, the first portion disposed on a sidewall of the first hole, the second portion disposed on a top surface of the substrate and extending in a first direction; and a diaphragm pad including a first portion and a second portion, the first portion disposed on a sidewall of the second hole, the second portion disposed on the top surface of the substrate and extending in a second direction.

10. The acoustic sensor apparatus of claim 9, wherein the diaphragm is electrically connected to the package substrate and the signal circuit unit through the diaphragm pad.

11. The acoustic sensor apparatus of claim 9, comprising a diaphragm connection portion provided in the second hole on a top surface of the package substrate and connected to the diaphragm pad, wherein the diaphragm pad is electrically connected to the package substrate and the signal circuit unit by the diaphragm connection portion.

12. The acoustic sensor apparatus of claim 9, comprising a lower electrode connection portion provided in the first hole on a top surface of the package substrate and connected to the lower electrode pad, wherein the lower electrode pad is electrically connected to the package substrate and the signal circuit unit through the lower electrode connection portion.

13. The acoustic sensor apparatus of claim 9, wherein the lower electrode pad is spaced apart from the diaphragm and the diaphragm pad.

14. The acoustic sensor apparatus of claim 9, wherein the acoustic sensor further comprises:

a supporting film disposed in the acoustic chamber and including a first portion and a second portion, the first portion extending in a third direction, the second portion extending in a fourth direction crossing the third direction; and a substrate insulating film disposed on the supporting film and the top surface of the substrate, wherein the lower electrode is disposed on the substrate insulating film.

15. The acoustic sensor of claim 4, further comprising a protection film having an annular shape and connected to the first and second portions of the supporting film, the protection film disposed on a bottom surface of the substrate insulating film.

16. The acoustic sensor apparatus of claim 9, further comprising a sacrificial layer that includes an annular portion and an extension portion, the annular portion disposed along an inner sidewall of the diaphragm, the extension portion protruding from the annular portion and disposed between the second portion of the lower electrode pad and the diaphragm.

17. The acoustic sensor apparatus of claim 14, further comprising a protection film having an annular shape and connected to the first and second portions of the supporting film, the protection film disposed on a bottom surface of the substrate insulating film.

* * * * *